US008570353B2

(12) United States Patent
Furukawa et al.

(10) Patent No.: US 8,570,353 B2
(45) Date of Patent: Oct. 29, 2013

(54) IMAGE FORMING APPARATUS

(75) Inventors: Takahiro Furukawa, Kanagawa (JP); Daisuke Tezuka, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 27 days.

(21) Appl. No.: 13/331,420

(22) Filed: Dec. 20, 2011

(65) Prior Publication Data

US 2012/0162340 A1 Jun. 28, 2012

(30) Foreign Application Priority Data

Dec. 24, 2010 (JP) ..... 2010-288221

(51) Int. Cl.
*B41J 29/16* (2006.01)

(52) U.S. Cl.
USPC ..... 347/179

(58) Field of Classification Search
USPC ..... 347/171, 179, 193, 213, 220, 224, 234, 347/248, 262, 139; 369/120
See application file for complete search history.

(56) References Cited

U.S. PATENT DOCUMENTS

| | | | |
|---|---|---|---|
| 5,619,243 | A | 4/1997 | Hotta et al. |
| 7,728,860 | B2 | 6/2010 | Kawahara et al. |
| 2008/0192618 | A1 | 8/2008 | Nakata et al. |

FOREIGN PATENT DOCUMENTS

| | | |
|---|---|---|
| JP | 10-86419 | 4/1998 |
| JP | 2002-234200 | 8/2002 |
| JP | 2004-90026 | 3/2004 |
| JP | 2004-322493 | 11/2004 |
| JP | 2007-216422 | 8/2007 |
| JP | 2008-68630 | 3/2008 |
| JP | 2008-194905 | 8/2008 |
| JP | 2009-172801 | 8/2009 |

OTHER PUBLICATIONS

The Extended European Search Report issued Mar. 6, 2012, in Europe Application No./Patent No. 11194558.0-1251.

*Primary Examiner* — Kristal Feggins
(74) *Attorney, Agent, or Firm* — Oblon, Spivak, McClelland, Maier & Neustadt, L.L.P.

(57) ABSTRACT

Disclosed is an image forming apparatus including a laser unit that has a function to emit a laser light to heat a thermal rewritable recording medium to write a drawing on the thermal rewritable recording medium and to erase a drawing written on the thermal rewritable recording medium by heating the thermal rewritable recording medium; and an erasing data generating unit that generates erasing data indicative of a position of an erasing area corresponding to a part of the thermal rewritable recording medium, the laser unit erasing the drawing written on the erasing area of the thermal rewritable recording medium based on the erasing data generated by the erasing data generating unit.

20 Claims, 16 Drawing Sheets

IMAGE FORMING APPARATUS

BACKGROUND OF THE INVENTION

1. Field of the Invention

The present invention relates to an image forming apparatus and more specifically, to an image forming apparatus that writes a drawing and erases a drawing by a laser light on a thermal rewritable recording medium.

2. Description of the Related Art

There is a case where a thermal paper is used for a label on which a name of an article or an address to send the article is printed. For example, such a label composed of the thermal paper is used for a plastic container at a factory. Such a label composed of the thermal paper has a property that its color changes by heat, and therefore, characters or symbols can be written on the label by a heating head or the like.

There has been developed a rewritable type where writing and erasing can be repeated for such a thermal paper. As for the label used for delivery, it is desirable to write and erase the information on the label while the label is kept attached to the container, therefore, a method by which characters are written on the label without contacting the label by emitting a laser light to heat the label has been proposed (for example, see Japanese Laid-open patent publication NO. 2004-90026). In Japanese Laid-open Patent Publication NO. 2004-90026, a writing apparatus including a relay lens composed of plural lenses and flexible joints where an image input to one end of the relay lens is output from the other end is disclosed.

As for such a label composed of the thermal paper of rewritable type (hereinafter referred to as "rewritable paper" as well) as described above is used, when rewriting a new content on the label, it is necessary to erase a content already written on the label before writing the new content on the label.

Japanese Laid-open Patent Publication NOs. 2007-216422, 2004-322493, 2009-172801 and 2008-194905 disclose methods for erasing the drawings such as characters or the like written on the thermal paper.

For example, there is disclosed in Japanese Laid-open Patent Publication NO. 2007-216422, a technique of erasing drawings of all the area of the thermal paper by blowing hot air onto all the area.

There is disclosed in Japanese Laid-open Patent Publication NO. 2004-322493, an apparatus for erasing drawings on the thermal medium by which light is condensed as a linear light and the light source is divided by shutters or the like to enable partial erasing on the thermal medium.

It is disclosed in Japanese Laid-open Patent Publication No. 2009-172801, that drawings on a thermal medium are erased by a laser beam the same as that used for writing drawings on the thermal medium without providing an additional device for erasing the drawings.

It is disclosed in Japanese Laid-open Patent Publication No. 2008-194905, that an area to be partially erased is extracted by comparing images and erased in a rewriting system using a laser apparatus for writing and a laser apparatus for erasing.

However, it takes time for rewriting according to the above described techniques. For example, when erasing all area of the label, it takes time for erasing. Further, according to the technique disclosed in Japanese Laid-open Patent Publication No. 2008-194905, the operation becomes complicated because it is necessary to compare images, which requires a long operational time. Further, an apparatus for obtaining the image is additionally required.

SUMMARY OF THE INVENTION

The present invention is made in light of the above problems, and may provide an image forming apparatus capable of setting a part to be erased on a thermal rewritable recording medium such as a rewritable paper efficiently.

The present invention has been made based on the knowledge the inventors have thus obtained and has the following configurations.

According to an aspect of the present invention, there is provided an image forming apparatus including a laser unit that has a function to emit a laser light to heat a thermal rewritable recording medium to write a drawing on the thermal rewritable recording medium and to erase a drawing written on the thermal rewritable recording medium by heating the thermal rewritable recording medium; and an erasing data generating unit that generates erasing data indicative of a position of an erasing area corresponding to a part of the thermal rewritable recording medium, the laser unit erasing the drawing written on the erasing area of the thermal rewritable recording medium based on the erasing data generated by the erasing data generating unit.

BRIEF DESCRIPTION OF THE DRAWINGS

Other object units, features and advantages of the present invention will become more apparent from the following detailed description when read in conjunction with the accompanying drawings.

DETAILED DESCRIPTION OF THE PREFERRED EMBODIMENTS

Figure 1:
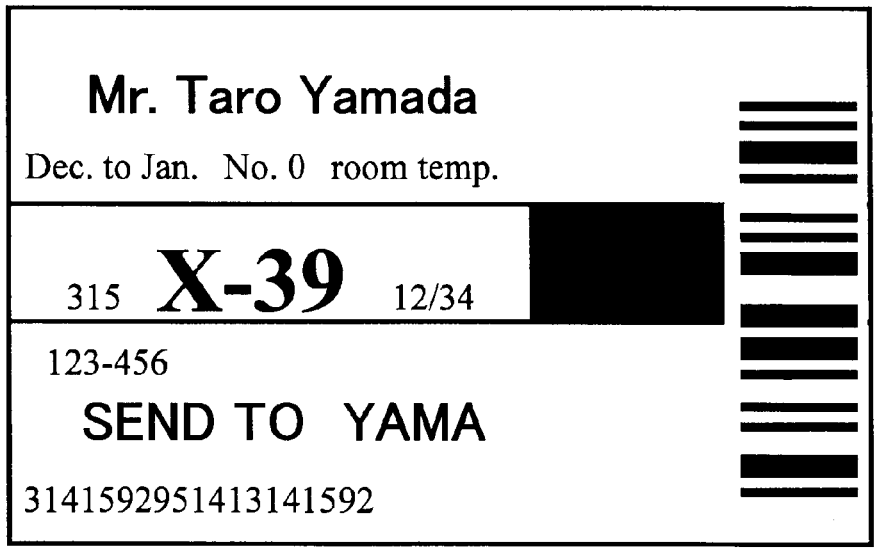
FIG. 1 is a drawing showing an example of a label on which drawings are written.

The invention will be now described with reference to illustrative embodiments. Those skilled in the art will recognize that many alternative embodiments can be accomplished using the teachings of the present invention and that the invention is not limited to the embodiments illustrated for explanatory purposes.

Next, embodiments of the present invention will be described below with reference to drawings.

It is to be noted that, in the explanation of the drawings, the same components are given the same reference numerals, and explanations are not repeated.

(First Embodiment)

In this embodiment, erasing data indicative of a position of an erasing area for erasing a drawing, such as a character, a diagram or the like, written and developed on a thermal rewritable recording medium such as a rewritable paper is generated. The erasing data is generated not to erase all of the area of the thermal rewritable recording medium but to erase a part of the area, 20% for example, desired to be erased. With this structure, selective erasing is performed in an erasing operation and the time necessary for rewriting can be reduced.

Further, by providing erasing data that can shorten the time necessary for rewriting in accordance with data to be written, rewriting operations can be performed efficiently in any environment without providing an additional device for erasing data such as an erasing bar or the like.

In this embodiment, "a stroke" means a line or a curve written by a single scan (from a starting point to an end point) of a laser light. Further, "a stroke" may include a broken line or curve or a dotted line or curve in addition to a sequential line or curve.

Further in this embodiment, a drawing such as a character, a symbol, a numeral, or a diagram formed by the strokes is referred to as an image or an object unit (or a drawing object unit) as well. Especially, when it is referred as "an object unit (or a drawing object unit)", that means a block of characters, symbols, numerals, or diagrams formed by the strokes. The drawing may include plural object units.

Further in this embodiment, forming an image may be referred as writing", "drawing", "recording", "printing" or "developing".

Further in this embodiment, "erase" means to erase a written image, and "rewrite" means to erase the written image and then write a new image.

Further, "drawing data" may be data to be supplied to a laser marker apparatus for controlling a laser light to write a drawing on a thermal paper by scanning with the laser light.

"Written data" may be a drawing data which is previously used to write a drawing on the thermal paper but is stored without being deleted. "Erasing data" may be data to be supplied to the laser marker apparatus for controlling a laser light to erase a drawing written on the thermal paper by scanning with the laser light. The erasing data may be indicative of a position of an erasing area. The erasing data and the drawing data may be formed to have same items.

When simply referred to as "data", all of the above data are included.

These data are assumed to be composed of commands that the laser marker apparatus can easily understand.

FIG. 1 is a drawing showing an example of a label on which drawings composed of numerals, characters, diagrams, a barcode and the like are written.

Figure 2:
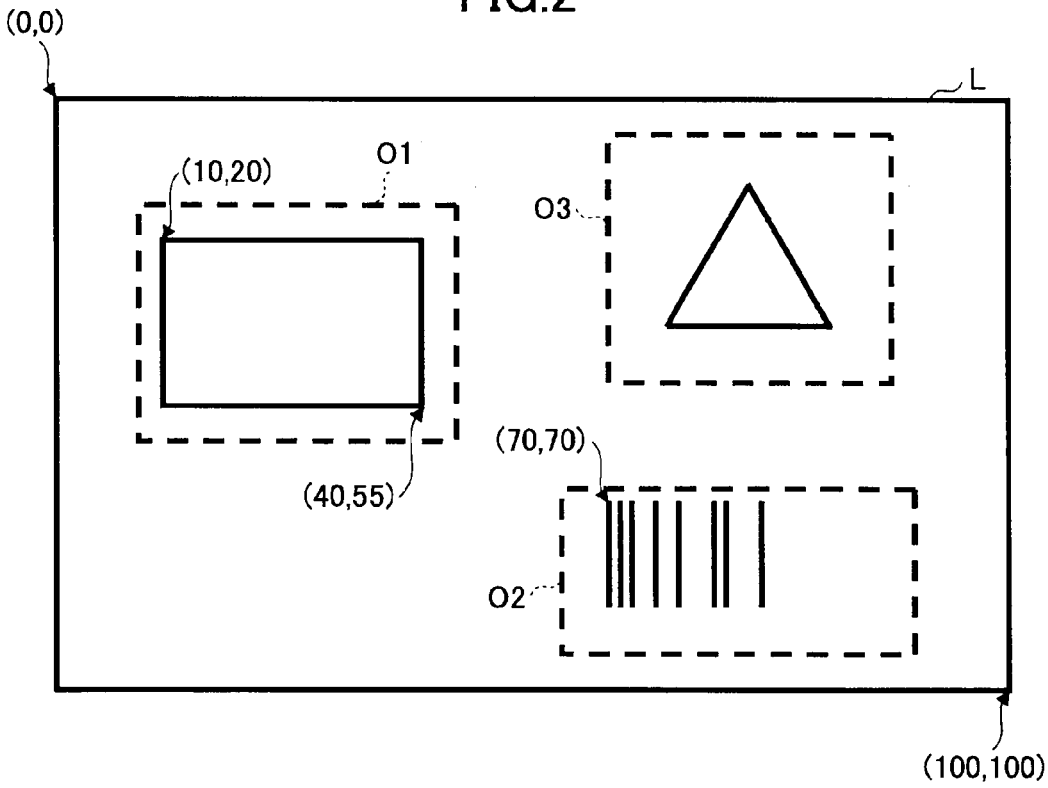
FIG. 2 is a drawing showing an example of drawing object units.

FIG. 2 is a drawing showing an example of drawing object units O1, O2, and O3. Numerals in brackets indicate coordinate values (X, Y) of corresponding points denoted by arrows.

Figure 3:
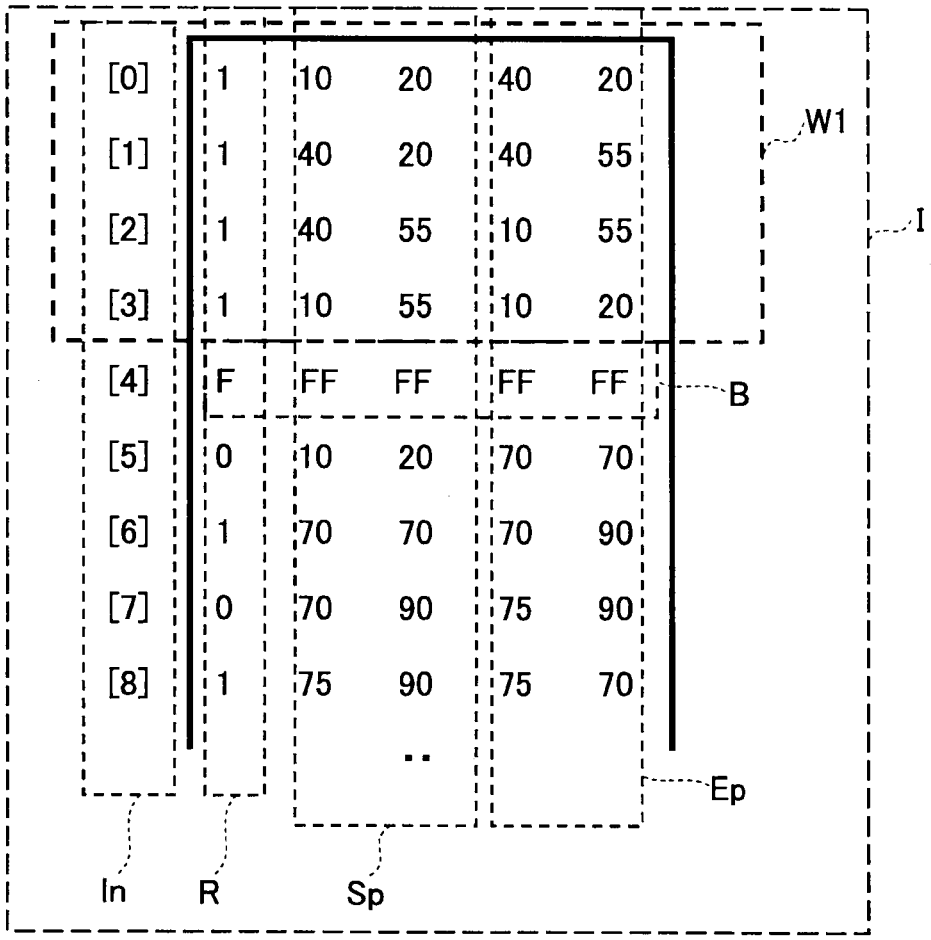
FIG. 3 is a drawing showing an example of a structure of drawing data for the drawing object units.

FIG. 3 is a drawing showing an example of a structure of drawing data I for the drawing object units.

The drawing data I includes, for each of the lines, line number ln, laser ON/OFF condition R, coordinate values of a starting point of a laser scan Sp, and coordinate values of an end point of the laser scan Ep.

In this example, the lines denoted with the line numbers [0] to [3] express examples of commands W1 for writing the drawing object unit O1 shown in FIG. 2. In this example, the line denoted with the line number [4] expresses an example of delimiter B delimiting the drawing object units.

Although not shown in the drawing, information such as laser power or control coefficient for scanning speed of the apparatus may be included in the drawing data I.

In the following embodiments, erasing data indicative of a position of an erasing area corresponding only to a part of the drawings on the thermal paper, or a thermal rewritable recording medium, is generated.

In the first embodiment, a position of an erasing area is identified based on the area where drawings are to be written and then erasing data indicative of the position of the erasing area for erasing drawings is generated based on the erasing area. Further in the first embodiment, there exist a type where the erasing area is set to surround the area where a drawing is written and the erasing data is generated based on such an erasing area, a type where the erasing area is set to correspond to object units to be written and the erasing data is generated based on such an erasing area and a type where the erasing area is obtained from an external apparatus and the erasing data is generated based on such an erasing area.

In the second embodiment, a position of an erasing area is identified based on written data that indicates drawings written on the thermal rewritable recording medium and drawing data that indicates drawings to be written. The erasing data is generated based on such an erasing area. It means that the written data of the currently written drawings and the drawing data of the drawings to be written are compared and the erasing data is generated by determining the difference part as the erasing area.

In the third embodiment, a position of an erasing area is identified based on written data that indicates drawings written on the thermal rewritable recording medium and the erasing data is generated based on such an erasing area. Further in the third embodiment, there exist a type where the erasing area is set by analyzing the written data and the erasing data is generated based on such an erasing area, a type where erasing data corresponding to the written data is obtained from an external apparatus and an erasing operation is performed based on the erasing data, and a type where erasing data corresponding to the written data is previously stored and an erasing operation is performed based on the erasing data.

(First Embodiment)

Figure 4:
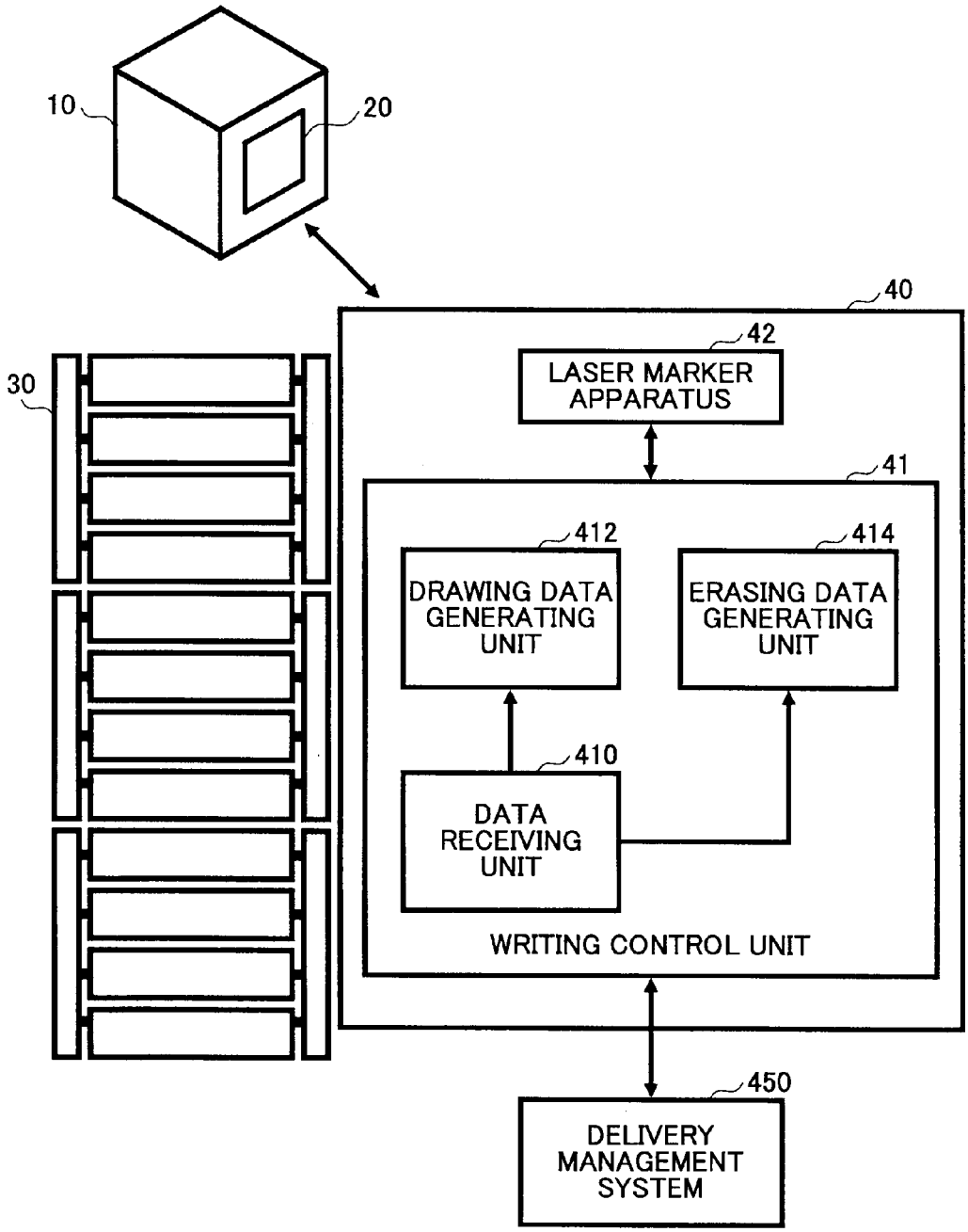
FIG. 4 is a drawing showing an example of a system structure according to a first embodiment.

FIG. 4 is a drawing showing an example of a system structure according to a first embodiment.

In this embodiment, the case where the system is a laser rewriting system that rewrites an image written on a rewritable paper attached to a container used for delivery by a laser. The laser rewriting system is used when rewriting drawings related to a content of articles in the container or an address to send the container to.

Referring now to FIG. 4, the system includes a conveyor 30, and a laser writing apparatus 40 placed at the side of the conveyor 30. The conveyor 30, serving as a conveying unit, holds and conveys a container 10 as an article to be managed.

In this embodiment, the laser writing apparatus 40 may be composed of an image forming apparatus. The laser writing apparatus 40 includes a writing control unit 41 and a laser marker apparatus 42.

The writing control unit 41 performs main control operations. The laser marker apparatus 42 (laser unit) writes an image on and erases an image from a rewritable paper 20 composing a label attached to the container 10. The laser marker apparatus 42 functions as an image writing unit and an image erasing unit.

The writing control unit 41 includes a data receiving unit 410, a drawing data generating unit 412, and an erasing data generating unit 414.

The data receiving unit 410 receives data to be written on the rewritable paper 20 from a delivery management system 450, for example.

The drawing data generating unit 412 generates drawing data for the laser marker apparatus 42 to write a new image on the rewritable paper 20 based on the data received by the data receiving unit 410. Alternatively, the data receiving unit 410 may receive the drawing data generated in the delivery management system 450 or the like. The erasing data generating unit 414 generates erasing data. This operation will be explained later in detail.

Although not shown in the drawings, the writing control unit 41 includes a CPU (Central Processing Unit), a ROM (Read Only Memory), a RAM (Random Access Memory) and the like and functions as the control unit to actualize the functions of the data receiving unit 410, the drawing data generating unit 412, and the erasing data generating unit 414.

The writing control unit 41 receives and sends data from and to the delivery management system 450 via a network and controls the laser marker apparatus 42 based on the received data.

Figure 5:
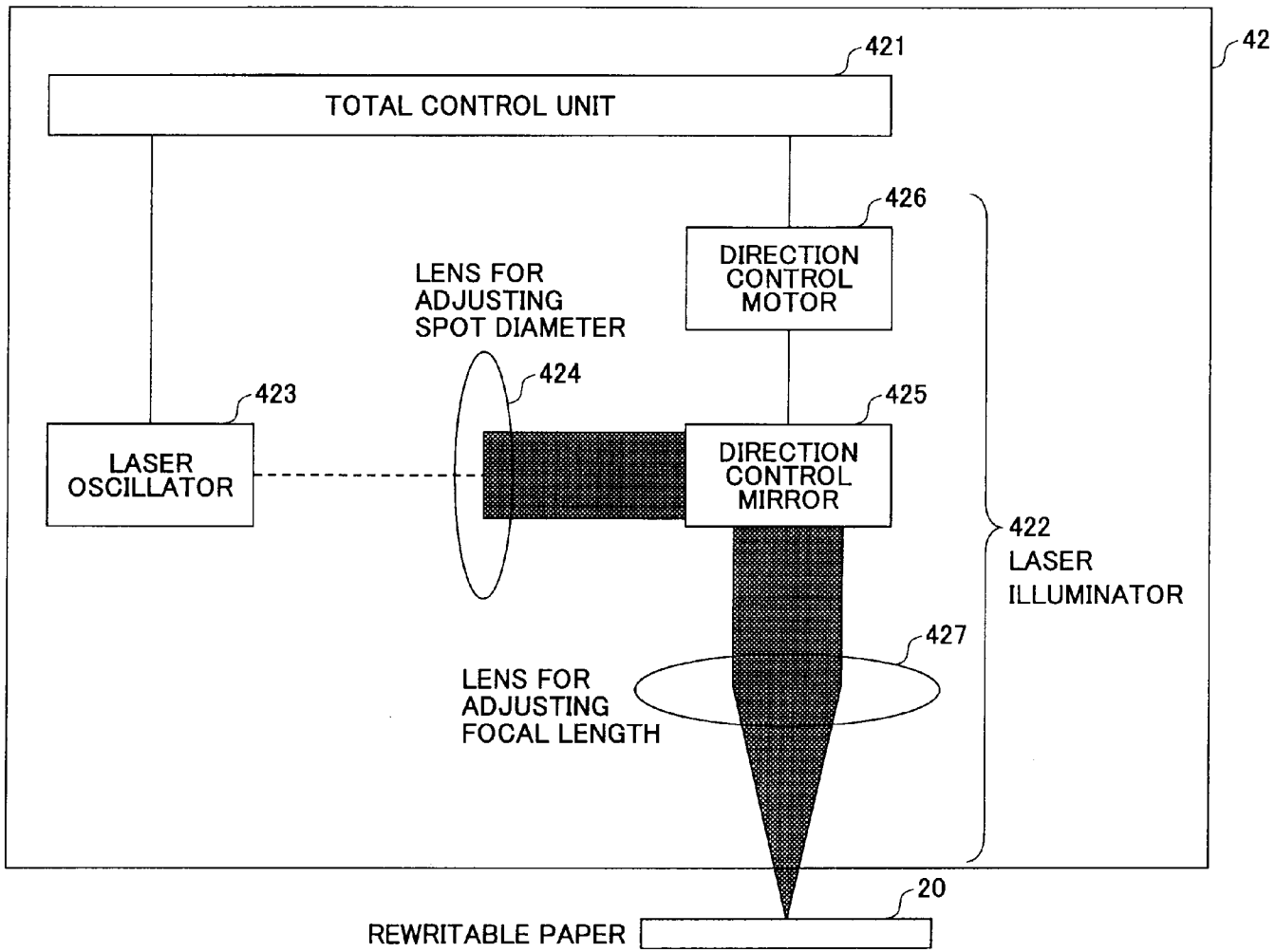
FIG. 5 is a drawing showing an example of the structure of the laser marker apparatus.

FIG. 5 is a drawing showing an example of the structure of the laser marker apparatus 42.

The laser marker apparatus 42 includes a total control unit 421 that controls all of the laser marker apparatus 42, and a laser illuminator 422 that emits a laser light.

The laser illuminator 422 includes a laser oscillator 423, a lens for adjusting spot diameter 424, a direction control mirror 425 called a galvanometer mirror, a direction control motor 426, and a lens for adjusting focal length 427.

The laser oscillator 423 generates a laser light. The lens for adjusting spot diameter 424 increases the spot diameter of the laser light. The direction control motor 426 moves the direction control mirror 425. The lens for adjusting focal length 427 adjusts the focal point of the laser light on the targeted rewritable paper 20.

The total control unit 421 controls the direction control motor 426 to move the direction control mirror 425 for adjusting the irradiation position. The total control unit 421 also controls the laser oscillator 423 for switching ON/OFF for generation of a laser light and adjusting the power. By adjusting the power, the width for a stroke can be controlled to vary to a certain extent.

The laser light generated by the laser oscillator 423 is reflected by the direction control mirror 425 in an adjusted direction after passing through the lens for adjusting spot diameter 424. The focal point of the laser light is then adjusted in accordance with the focal length to the rewritable paper 20 by the lens for adjusting focal length 427 to form a drawing on the rewritable paper 20.

In this embodiment, the total control unit 421 controls other components of the laser marker apparatus 42 to write an image on and erase an image from the rewritable paper 20.

When writing the image, a laser light adjusted to write an image is irradiated on the rewritable paper 20 and the part where the laser light is irradiated is heated to show a color by the heat. Thus, by adjusting the irradiation position of the laser light on the rewritable paper 20, drawings such as characters or the like can be written on the rewritable paper 20.

When erasing the image written on the rewritable paper 20, a laser light adjusted to erase an image is irradiated on the rewritable paper 20. Concretely, when erasing the image, the laser light is generated with a lower power and defocused to have a broader irradiation area.

In this embodiment, all area of the label attached to the container 10 may be composed of the rewritable paper 20. The rewritable paper 20 may have a size of A4, for example. Alternatively, only a part of the label may be composed of the rewritable paper 20. In such a case, the label may have a size of A4, for example, and the rewritable paper 20 may compose a smaller area.

The rewritable paper 20 may be composed of four layers including a protective layer, a recording layer composed of a heat-reversible recording medium such as a heat-reversible (thermo-chromic) film, a base layer, and a back coating layer, formed from the front surface to the backend in a depth direction in this order. The rewritable paper 20 may have a certain strength as well as flexibility so that it is reusable.

The heat-reversible recording medium may be a type whose degree of transparency varies reversibly depending on the temperature or a type whose color tone varies reversibly depending on the temperature.

In this embodiment, the heat-reversible film of the type whose color tone varies reversibly depending on the temperature where the recording layer includes leuco dyes and developers may be used. As for this case, when a non-colored heat-reversible film is heated to a temperature equal to or higher than the melting point (for example, 180 degrees centigrade) and quenched, leuco dyes and the developers are melted and mixed together to be colored and the leuco dyes and the developers aggregate regularly to a certain extent under a coupled condition so that the colored status is maintained. When the colored heat-reversible film is heated to a temperature not as high as the melting point, for example, 130 degrees centigrade to 170 degrees centigrade, the color is erased. At this time, the developers separate from the leuco dyes to form crystals themselves and color disappears. Any known leuco dyes a precursor of which is achromatic or hypochromic may be used as the leuco dyes.

Figure 6:
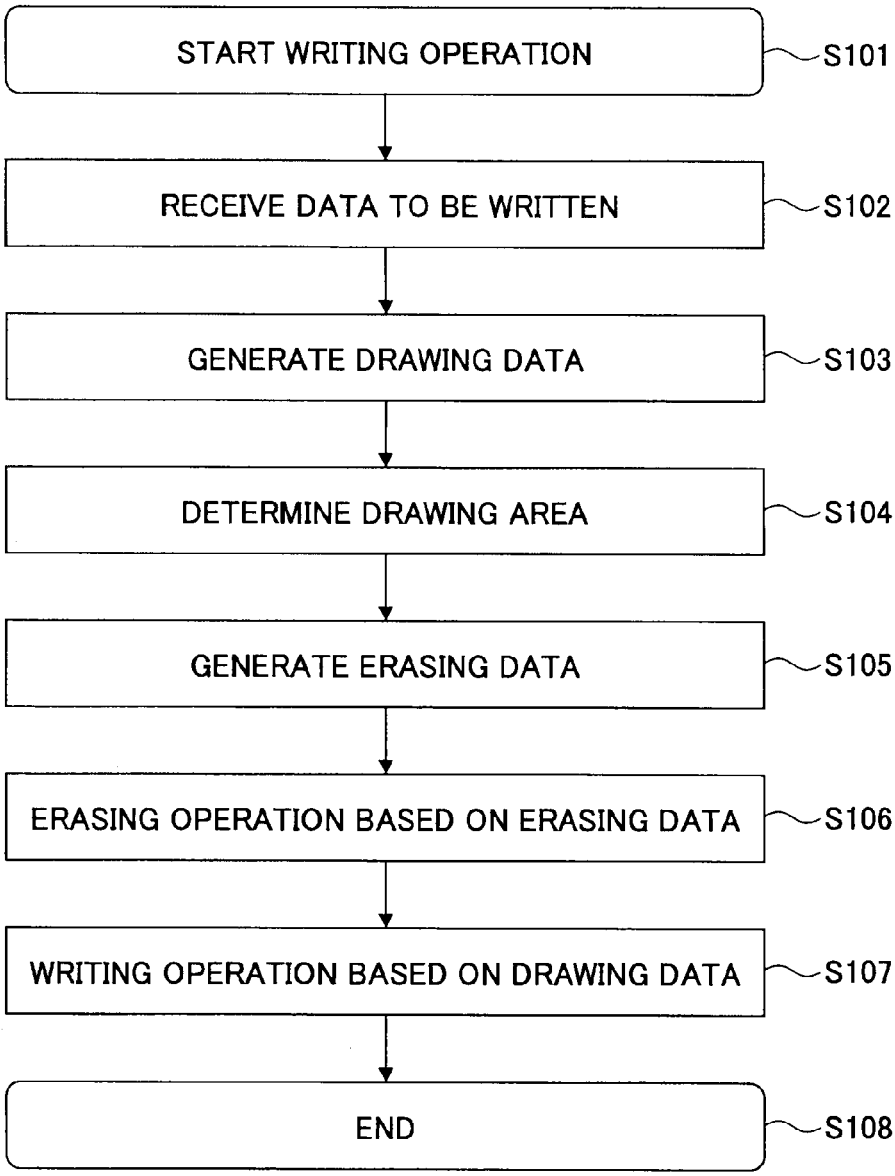
FIG. 6 is a flowchart showing an example of an operation in which laser erasing and laser writing processes are performed according to the first embodiment.

FIG. 6 is a flowchart showing an example of an operation in which laser erasing and laser writing processes are performed by the laser writing apparatus 40 as described above according to the first embodiment.

The laser writing apparatus 40 is used, for example, when an article to be delivered is packed in the container 10 and delivery information for the article is to be written on the rewritable paper 20 attached to the container 10 and on which instruction data for packing is already written.

The container 10 is mounted on the conveyor 30 to be conveyed by the conveyor 30.

The conveyor 30 conveys the container 10 to the position where the laser marker apparatus 42 erases and writes the rewritable paper 20. In this embodiment, the erasing operation and the writing operation are performed at the same position.

When the container 10 is conveyed by the conveyor 30 to such a position and the operation of writing starts (step S101), a signal for rewriting is sent from the delivery management system 450 and the data receiving unit 410 of the writing control unit 41 receives data to be written on the rewritable paper 20 sent from the delivery management system 450 (step S102). The data to be written is composed of information such as coordinate values or the like indicating the position where the drawing is written and a content of the drawing to be written. The data may be set by a user through an external tool such as a layout apparatus or a host apparatus.

Then, the drawing data generating unit 412 of the writing control unit 41 generates drawing data for the laser marker apparatus 42 to write new drawings on the rewritable paper 20 based on the received data to be written (step S103). The drawing data is composed of commands such as the laser scanning tracks (coordinate values of a starting point of each scan and an end point of each laser scan), laser ON/OFF condition, power of the laser, speed of scanning, and the like as described above with reference to FIG. 3.

Thereafter, before writing the new drawing, a drawing already written on the rewritable paper 20 attached to the container 10 is erased.

Here, at such a delivery center, rapid rewriting operation is more important than to rewrite the drawings beautifully organized. It means that it is enough to have the content of the drawings understood or recognized by a person or a device that handles the container 10.

Figure 7A:
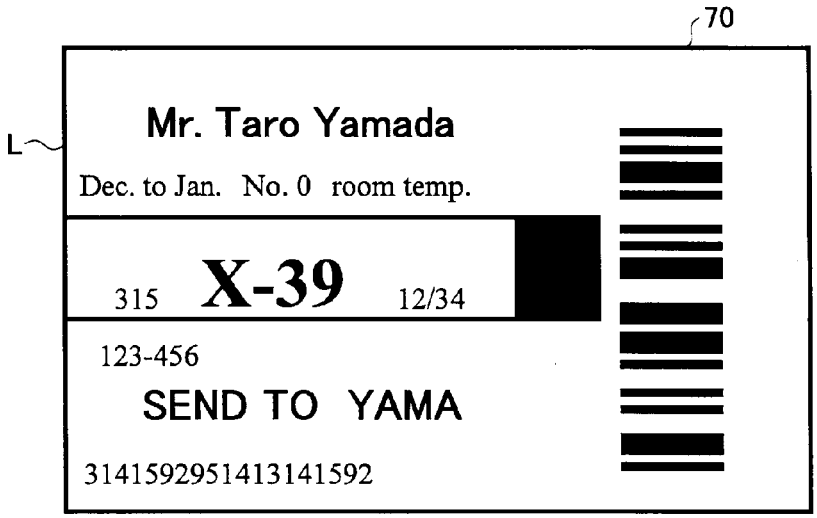
FIGS. 7A to 7C are drawings showing an example of the label.
Figure 7B:
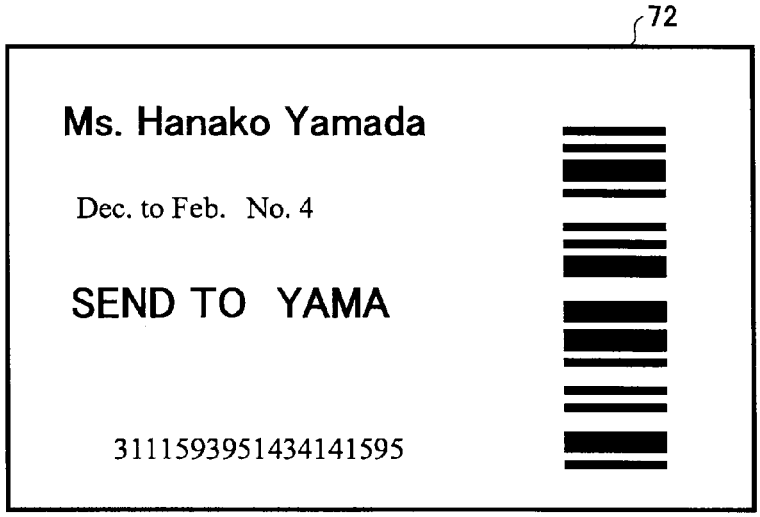
Figure 7C:
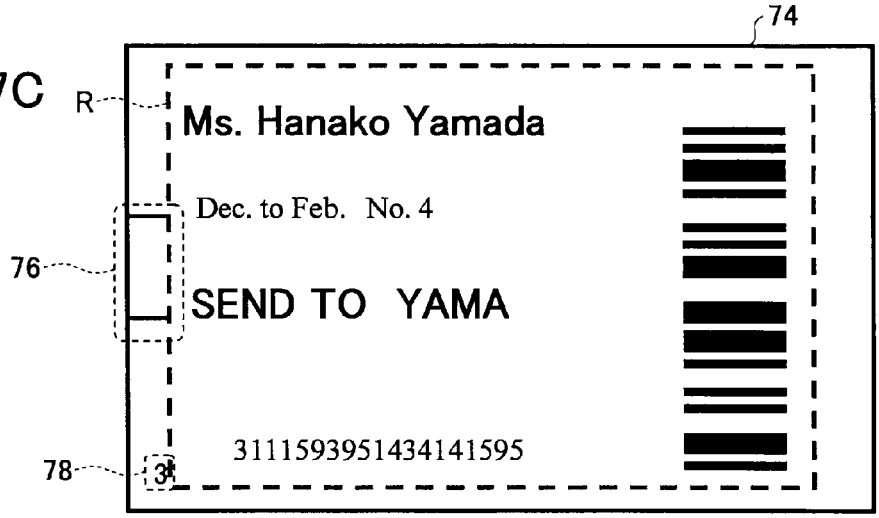

FIGS. 7A to 7C are drawings showing an example of the labels. It is supposed that a label 70 as shown in FIG. 7A is currently attached to the container 10. When the label 70 is have written a label 72 as shown in FIG. 7B, it is not necessary to erase the drawings of all the area L of the label 70.

As shown in FIG. 7C, for example, there is no problem even when a part of the drawings, surrounded by circles 76 and 78 shown by dotted lines, of the label 70 remain at the peripheral area of a new label 74. When such a rewriting operation is performed, it is necessary for the laser marker apparatus 42 to erase only the part, surrounded by a square R shown by a dotted line of the label 70. This reduces the necessary time for erasing the drawings compared to the case when the drawings of all the area L (shown in FIG. 7A) are erased.

In order to perform such an erasing operation, the erasing data generating unit 414 of the writing control unit 41 analyzes the drawing data generated in step S103 to determine a position of a drawing area where the drawings are to be included, for example, the area surrounded by the square R as shown in FIG. 7C (step S104). Concretely, the erasing data generating unit 414 analyzes the drawing data, obtains coordinate values of strokes where the laser condition is ON (Sp and Ep correspond with laser ON/OFF condition R of "1" as shown in FIG. 3) and determines the drawing area that surrounds the drawings to be written based on the thus obtained coordinate values by extracting the minimum value and the maximum value of the strokes.

Then, based on the thus determined drawing area, the erasing data generating unit 414 sets an appropriate erasing area. Concretely, but not so limited, the erasing data generating unit 414 may set the erasing area as expanding the drawing area determined in step S104 as large as the width of the laser light or the like.

Subsequently, the erasing data generating unit 414 generates erasing data for the laser marker apparatus 42 to erase the image written on the area of the rewritable paper 20 corresponding to the erasing area set as described above (step S105).

The writing control unit 41 sends the thus generated erasing data with erasing signals to the laser marker apparatus 42. The laser marker apparatus 42 performs the erasing operation of erasing the drawings written on the rewritable paper 20 attached to the container 10 based on the received erasing data and the erasing signals (step S106).

After the erasing operation is completed, the writing control unit 41 sends the drawing data generated in step S103 with writing signals to the laser marker apparatus 42. The laser marker apparatus 42 performs the writing operation of writing the drawings on the rewritable paper 20 attached to the container 10 based on the received drawing data and the drawing signals (step S107). The process ends (S108).

According to the operation as described above, the laser marker apparatus 42 only erases the part of the rewritable paper 20 set based on the drawing data to be written on the rewritable paper 20 attached to the container 10, and therefore a time required for erasing operations can be shortened.

Another Example

Figure 8:
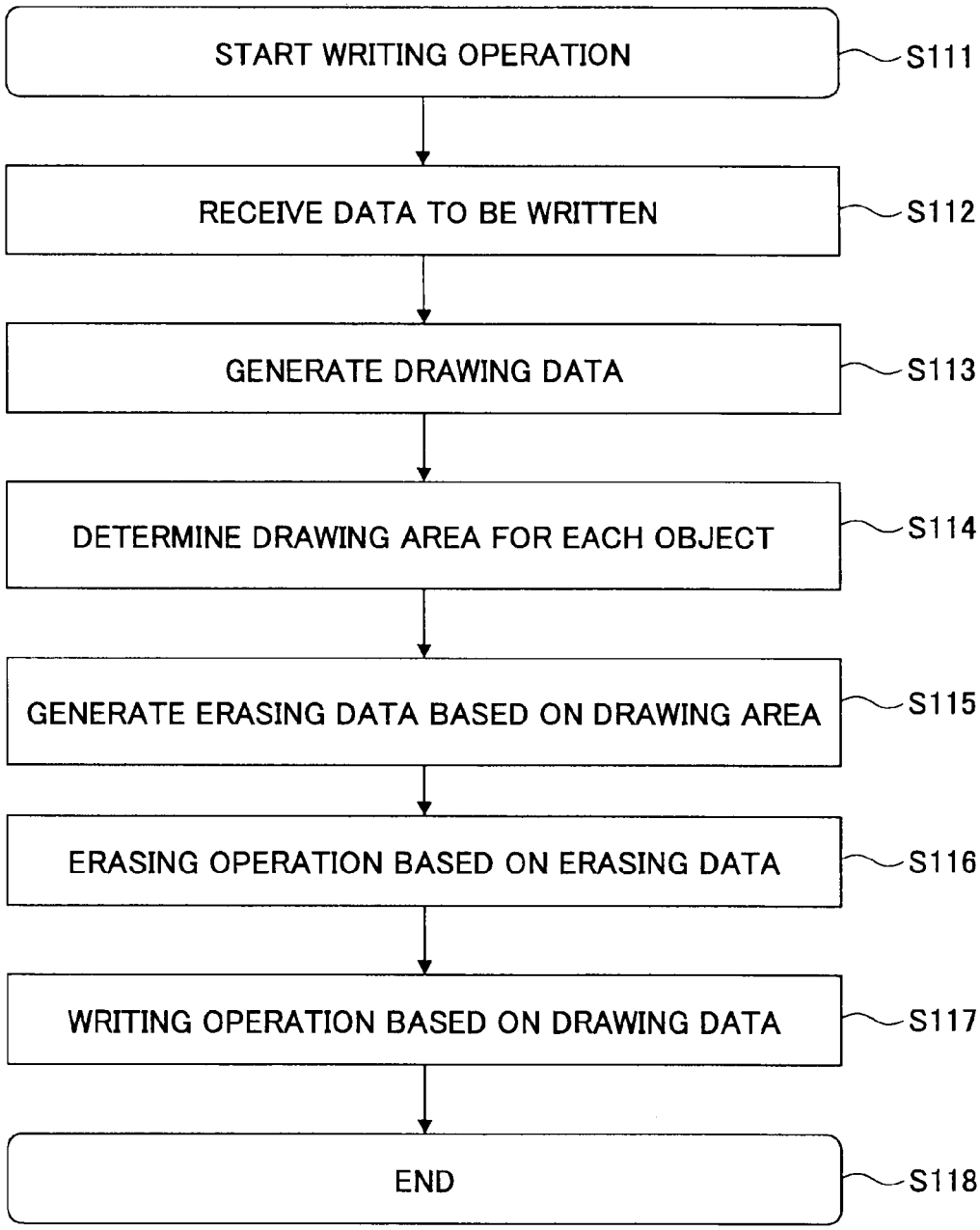
FIG. 8 is a flowchart showing another example of an operation in which laser erasing and laser writing processes are performed according to the first embodiment.

FIG. 8 is a flowchart showing another example of an operation in which a laser writing process is performed by the laser writing apparatus 40 as described above according to the first embodiment.

In FIG. 8, start of the operation (step S111), receiving data to be written (step S112) and generating the drawing data (step S113) are the same as step S101 to step S103 explained above with reference to FIG. 6.

Although in the above example, the erasing area for erasing the drawings is set to surround all of the drawings to be written on the rewritable paper 20, the erasing may be set for each of the object units so that the erasing areas are set to surround the corresponding object units. By such an operation, erasing time can be more reduced.

The erasing data generating unit 414 detects and sets one or more drawing areas each of which surrounds an object unit to be written on the rewritable paper 20 (step S114). Then, the erasing data generating unit 414 generates a single erasing data including positions of one or more erasing areas corresponding to the thus set one or more drawing areas (step S115).

Concretely, in step S114, the erasing data generating unit 414 analyzes the drawing data and obtains coordinate values for each of the object units where the laser condition is ON (Sp and Ep correspond with laser ON/OFF condition R of "1" as shown in FIG. 3) based on the delimiters B (see FIG. 3). For example, as for the object unit O1 shown in FIG. 2, the erasing data generating unit 414 recognizes the commands for the object unit and determines a drawing area for the object unit based on the thus obtained coordinate values by extracting the minimum value and the maximum value for the object unit.

Further in step S115, as described above with reference to step S105 of FIG. 6, the erasing data generating unit 414 sets an appropriate erasing area for each of the object units as expanding the drawing area determined in step S114 as large as the width of the laser light or the like.

Thereafter, an erasing operation is performed based on the thus generated erasing data (step S116), then writing operation is performed based on the drawing data (step S117), and the process ends (step S118).

Figure 9A:
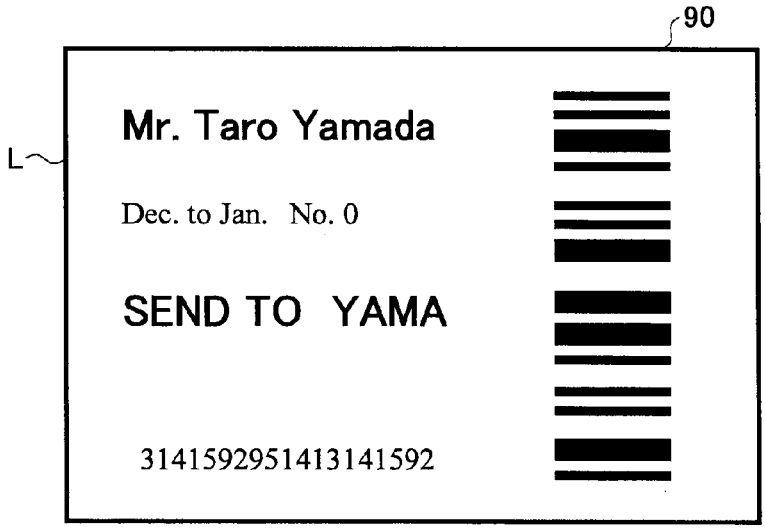
FIGS. 9A to 9C are drawings showing an example of the label.
Figure 9B:
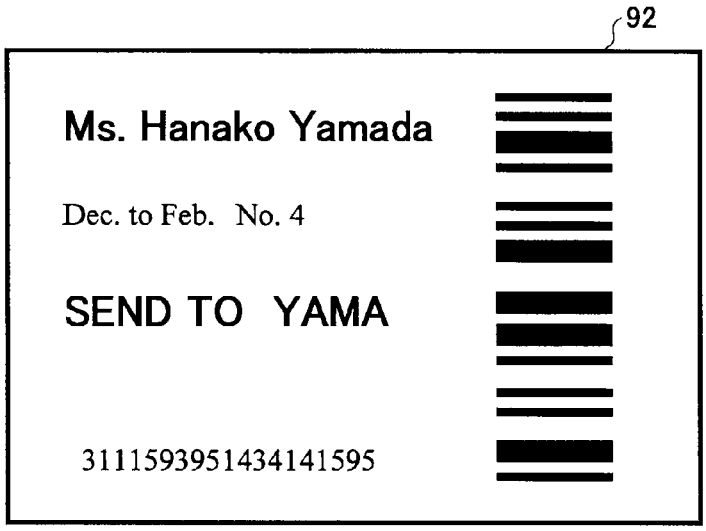
Figure 9C:
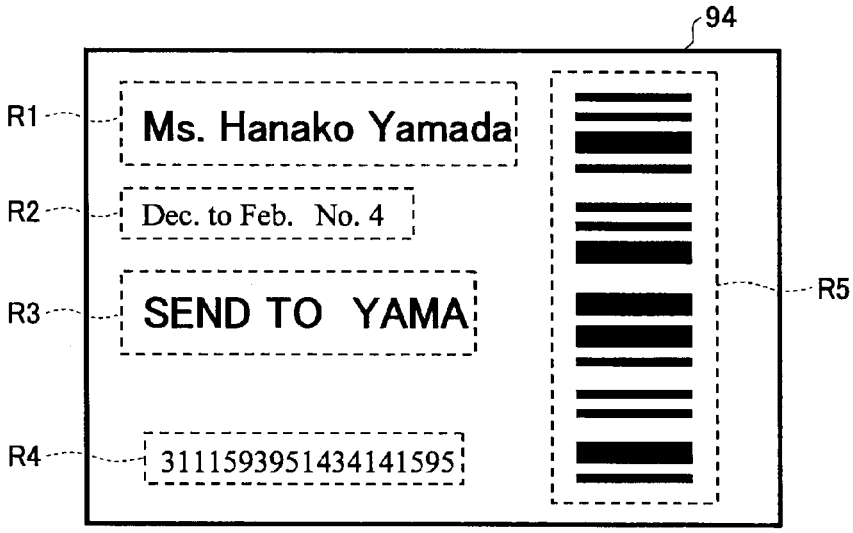

By performing the operations of step S114 and step S115, the erasing area where the laser marker apparatus 42 is to erase the drawings, when it is necessary for the drawings shown in a label 92 of FIG. 9B to be written on a label 90 of FIG. 9A, becomes the areas surrounded by the dotted lines R1 to R5 of a label 94 of FIG. 9C. Therefore, only the areas surrounded by the dotted lines R1 to R5 are necessary to be erased and therefore the time necessary for the erasing operation can be shortened.

Although in the above examples, the case is disclosed where the erasing area is set by the erasing data generating unit 414 by analyzing the drawing data, the erasing area may be set by a user through an external tool such as a layout apparatus by directly indicating the coordinate values of the like. Then, data including such a set erasing area may be sent from a host apparatus such as the delivery management system 450, similar to the data to be written, and the data generating unit 414 may generate the erasing data based on the thus obtained data.

(Second Embodiment)

Figure 10:
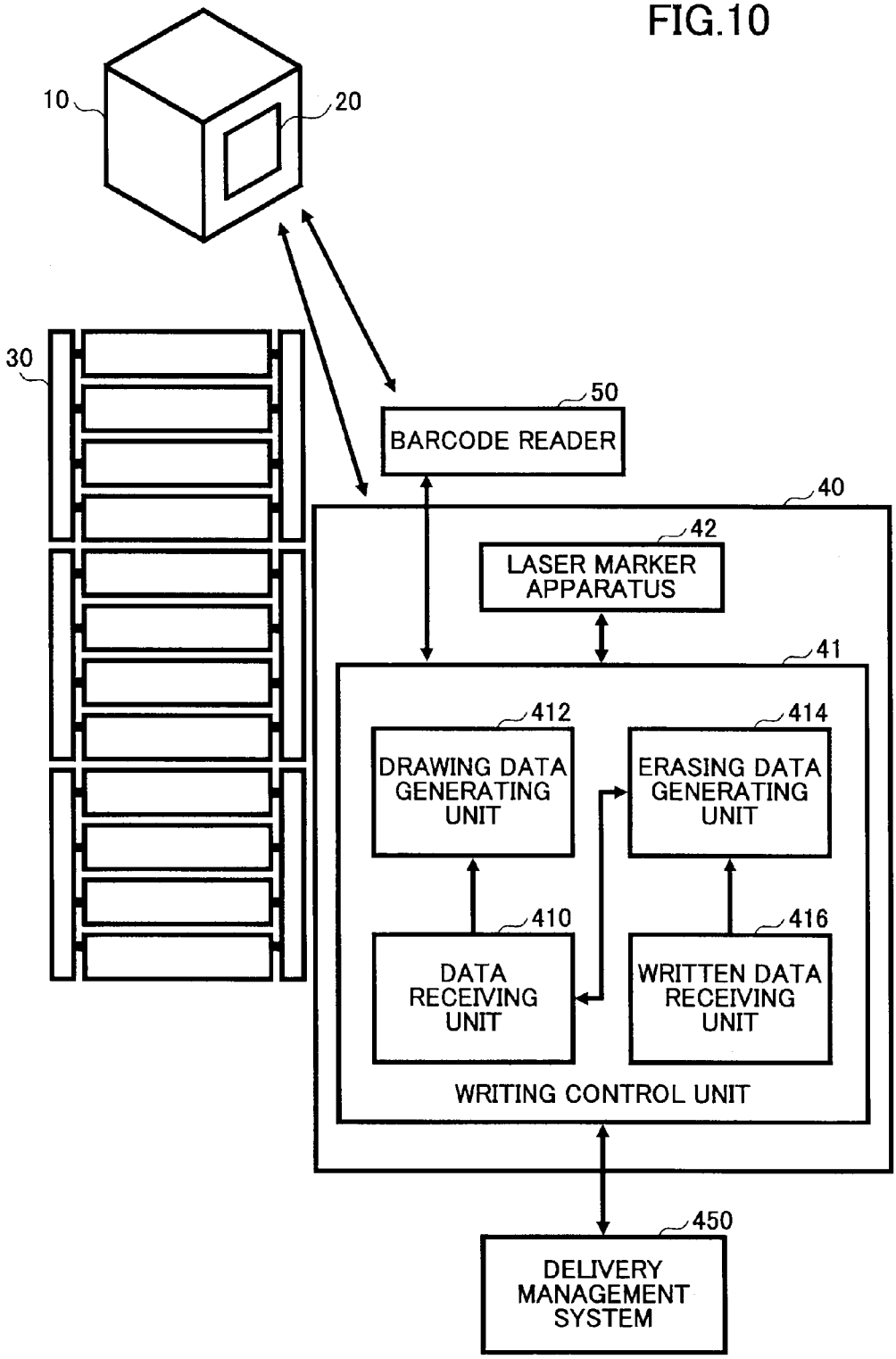
FIG. 10 is a drawing showing an example of a system structure according to a second embodiment.

FIG. 10 is a drawing showing an example of a system structure according to a second embodiment.

In FIG. 10, the system further includes a barcode reader 50 in addition to the components as shown in FIG. 4 of the first embodiment. Further, the writing control unit 41 further includes a written data receiving unit 416 in addition to the components as shown in FIG. 4 of the first embodiment.

In this embodiment, a method of determining the erasing area is different from that explained in the first embodiment.

In this embodiment, on the rewritable paper 20, as the label, attached to the container 10, a barcode that corresponds to an ID data specifying the content of the drawings is included in the drawings on the rewritable paper 20.

Figure 11:
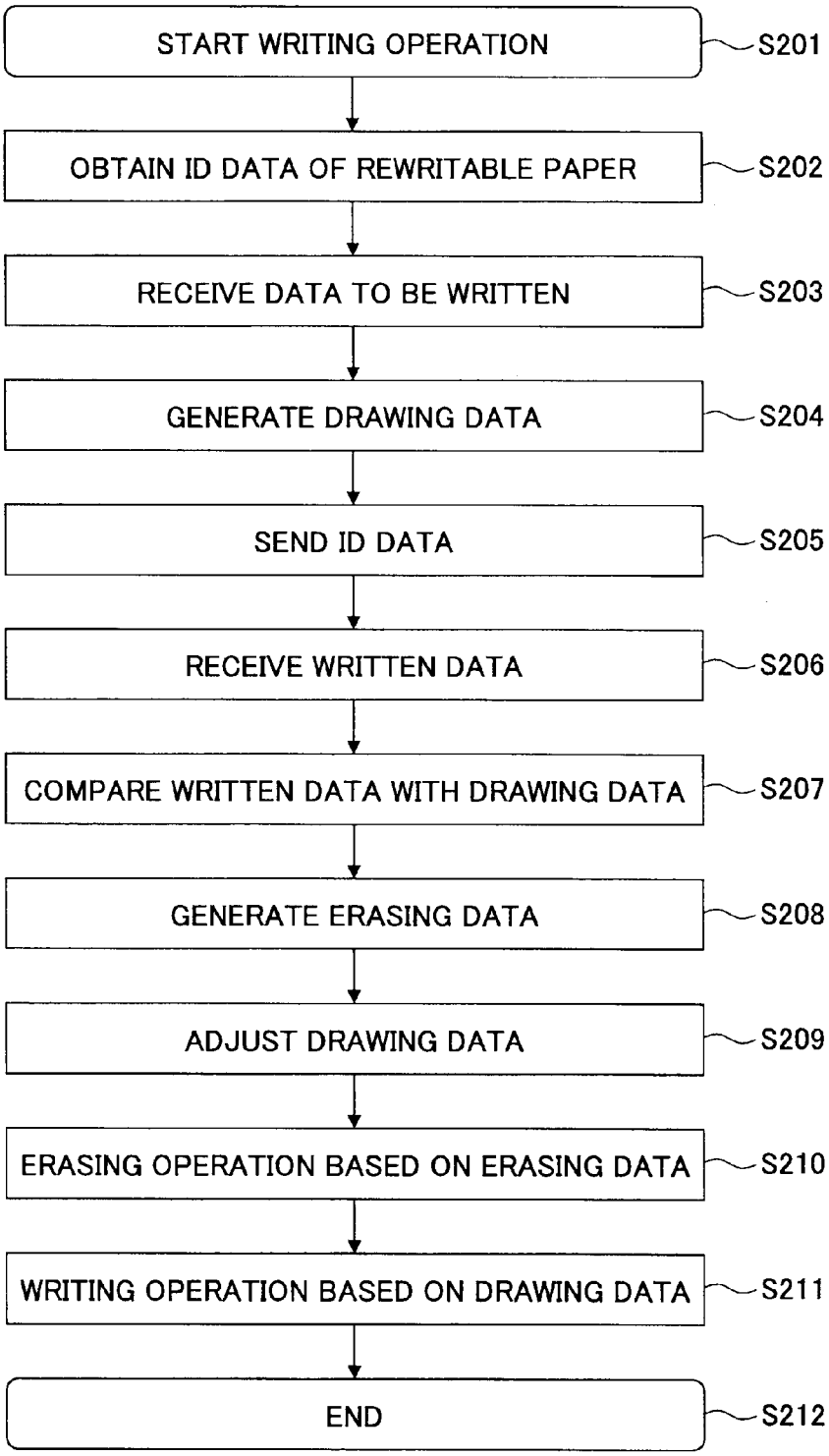
FIG. 11 is a flowchart showing an example of an operation in which laser erasing and laser writing processes are performed according to the second embodiment.

FIG. 11 is a flowchart showing an example of an operation in which laser erasing and laser writing processes are performed by the laser writing apparatus 40 as described above according to the second embodiment.

When the operation starts (step S201), the barcode reader 50 reads the barcode written on the rewritable paper 20 attached to the container 10 to be rewritten. Then, the writing control unit 41 obtains ID data that specifies the content of the drawing written on the rewritable paper 20 from the barcode reader 50 (step S202).

Then, the container 10 to be rewritten is conveyed by the conveyor 30 to the position where the laser marker apparatus 42 rewrites the rewritable paper 20. Alternatively, the barcode reader 50 may be provided with the laser marker apparatus 42 and the barcode may be read after the container 10 is conveyed by the conveyor 30 to the position where the laser marker apparatus 42 rewrites the rewritable paper 20.

When the container 10 is conveyed by the conveyor 30 to the position where the laser marker apparatus 42 rewrites the rewritable paper 20, a signal for rewriting is sent from the delivery management system 450 and the data receiving unit 410 of the writing control unit 41 receives data to be written on the rewritable paper 20 attached to the container 10 sent from the delivery management system 450 (step S203). Then, the drawing data generating unit 412 of the writing control unit 41 generates drawing data for the laser marker apparatus 42 to write new drawings on the rewritable paper 20 based on the received data to be written (step S204).

Thereafter, erasing operations will be performed. In this embodiment, the written data receiving unit 416 of the writing control unit 41 sends the ID data of the rewritable paper 20 read by the barcode reader 50 to the delivery management system 450 (step S205).

The delivery management system may store data used for writing the drawings currently written on the rewritable paper 20 by a laser marker apparatus, the laser marker apparatus 42 for example, in accordance with the ID data that indicates the drawings and corresponds to the barcode currently written on the rewritable paper 20.

Upon receiving the ID data from the writing control unit 41, the delivery management system 450 sends the data (hereinafter, referred to as "written data" in order to avoid confusion) used for writing the drawings currently written on the rewritable paper 20 corresponding to the ID data sent from the writing control unit 41 by using the ID data as a key, to the writing control unit 41. The written data receiving unit 416 of the writing control unit 41 receives the written data (step S206).

The erasing data generating unit 414 of the writing control unit 41 compares the written data received by the written data receiving unit 416 with the drawing data to be written on the rewritable paper 20 generated in step S204, and extracts an area necessary to be written as an erasing area (step S207).

Figure 12:
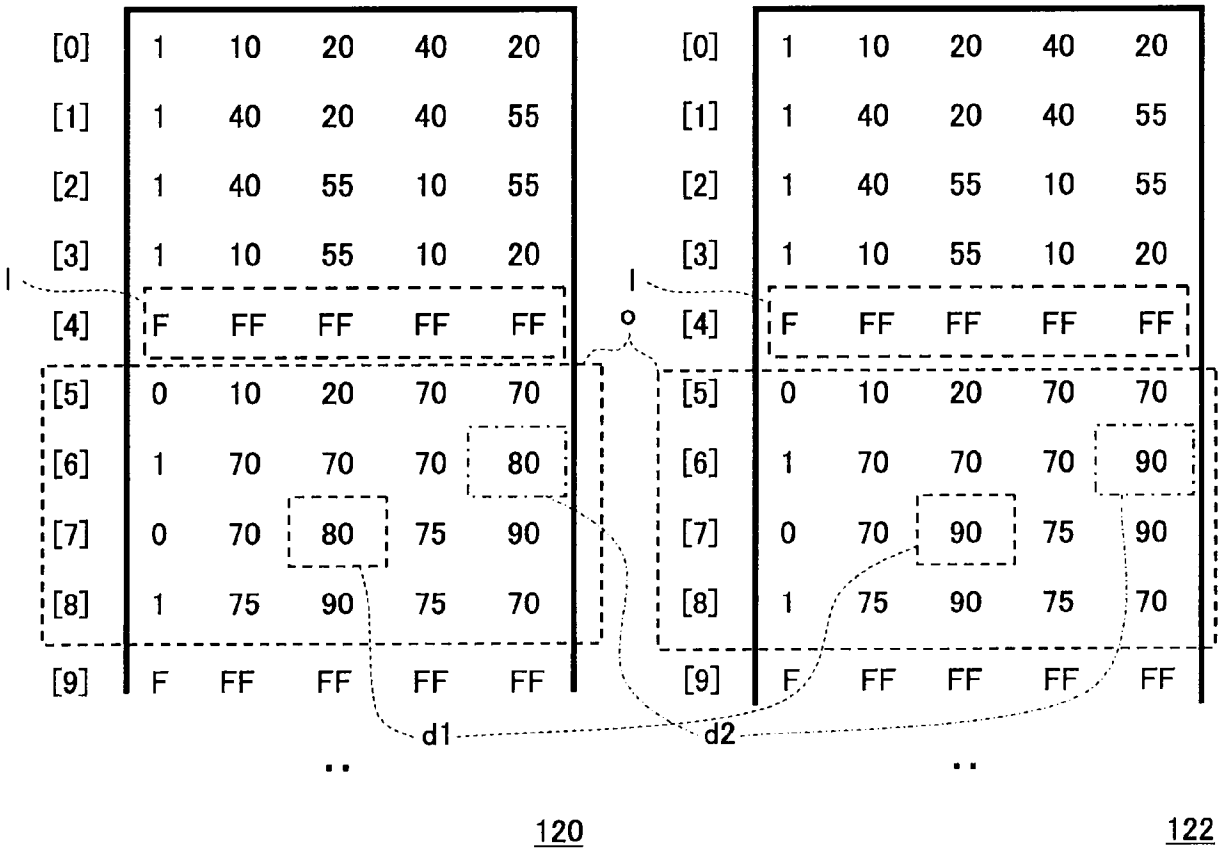
FIG. 12 is an explanatory view for explaining a comparison between the written data and the drawing data.

FIG. 12 is an explanatory view for explaining comparison between the written data 120 and the drawing data 122. The written data 120 indicates the drawings currently shown on the rewritable paper 20. The drawing data 122 indicates the drawings to be written on the rewritable paper 20.

In this example, the line denoted with the line number [4] expresses an example of delimiters 1 delimiting the drawing object units. The erasing data generating unit 414 detects the differences "d1" and "d2" between the written data 120 and the drawing data 122 and detects the object unit O that includes the differences as the object unit to be erased.

The erasing data generating unit 414 determines a drawing area of the object unit to be erased based on the coordinate values by extracting the minimum value and the maximum value of the object unit.

The erasing data generating unit 414 sets an appropriate erasing area in a similar manner as set in the first embodiment, and then generates erasing data based on the erasing area (step S208).

By performing the operations of step S207 and step S208, the erasing data for only erasing the erasing area where the difference exist between the written image and image to be written is generated.

In the above method, the difference can be detected based on the data without generating images, different from the technique disclosed in Japanese Laid-open Patent Publication NO. 2008-194905, and rapid generation of the erasing data can be performed.

Then, the drawing data generating unit 412 of the writing control unit 41 removes the data of the object unit that does not include the difference between that of the written data in step S207 from the drawing data (step S209). Concretely, similar to step S207, the drawing data generating unit 412 compares the written data with the drawing data and removes the data of the object unit in which no difference is detected to form an optimum drawing data.

By performing the operation of step S209, the drawing data that includes only the different part between the image already written on the rewritable paper 20 and the image to be written on the rewritable paper 20 is generated.

The laser marker apparatus 42 performs an erasing operation on the rewritable paper 20 attached to the container 10 based on the thus generated erasing data (step S210), then performs a writing operation to the rewritable paper 20 attached on the container 10 (step S211), and the process ends (step S212).

By performing those steps, the time necessary for the laser marker apparatus 42 to rewrite the drawings on the rewritable paper 20 attached to the container 10 can be shortened as the erasing operation and the writing operation are performed only on the area where the difference exists between the written drawings and the drawings to be written.

Figure 13:
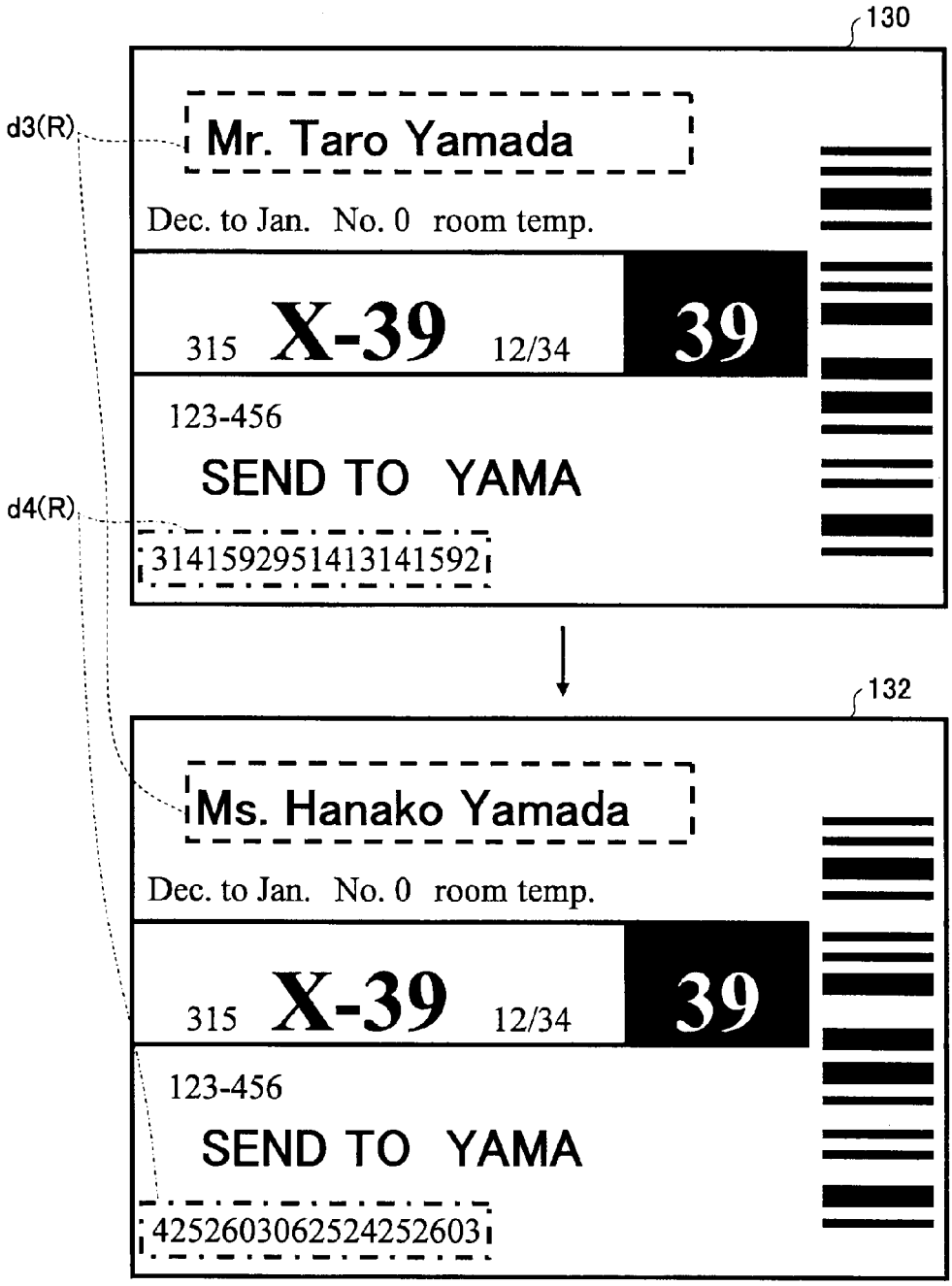
FIG. 13 is a drawing showing an example of the label.

FIG. 13 is a drawing showing an example of a label. When a current label 130 is written to be a label 132, the erasing area R corresponds to the differences d3 and d4.

Further, when adding a drawing such as a mark or the like to a space of the written drawing, there exists a difference between the currently written drawing and the drawing to be written. In such a case, it is not necessary to erase the area corresponding to the difference. Therefore, the erasing data generating unit 414 may detect a space on the written drawing based on the written data, and identify the position of the erasing area not to include such a space.

Alternatively, the erasing data generating unit 414 may first detect an area where a same drawing exists in the written drawing and the drawing to be written as well as detecting a space in the written drawing, and then identify the position of the erasing area not to include the area where the same drawing exists and the area where the space exists by comparing the written data and the drawing data.

With these operations, the space is not identified as the erasing area and the time necessary for erasing the drawings may be shortened.

Further, it is described above that the drawing data is generated to include only the different part between the drawing already written and the drawing to be written is generated. However, the drawing to be written may include an additional drawing that corresponds to a space in the written drawing. The laser marker apparatus 42 may be controlled not to write the drawing corresponding to the area where a same drawing exists.

(Third Embodiment)

The system according to the present embodiment may be the same as that shown in FIG. 10 in the second embodiment. In this embodiment, a method of determining the erasing area is different from that explained in the first and second embodiments.

The container 10 is conveyed by the conveyor 30 in this embodiment as well. It is assumed that the barcode that corresponds to an ID data specifying the content of the drawings is included in the drawings on the rewritable paper 20 as described in the second embodiment.

Figure 14:
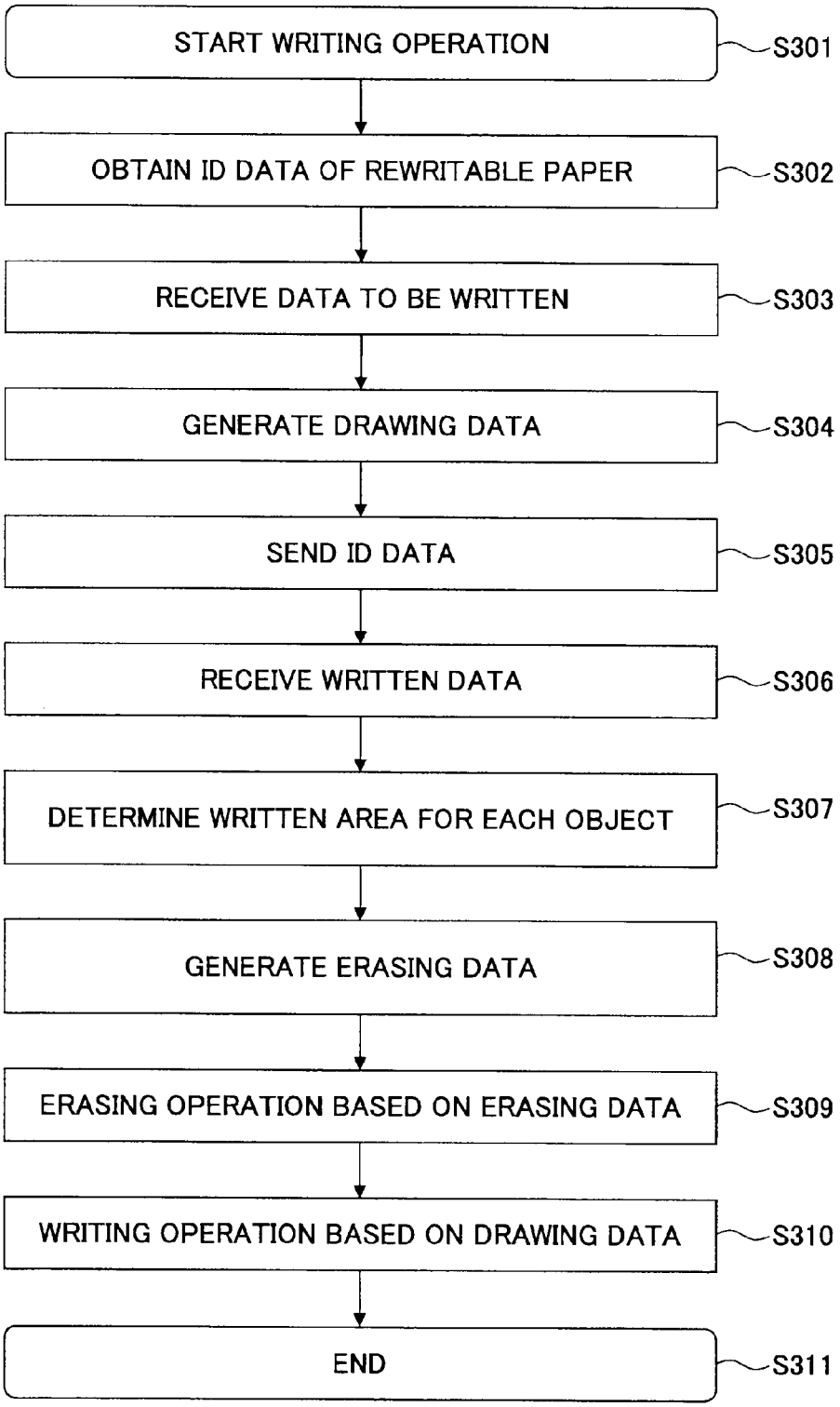
FIG. 14 is a flowchart showing an example of an operation in which laser erasing and laser writing processes are performed according to a third embodiment.

FIG. 14 is a flowchart showing an example of an operation in which laser erasing and laser writing processes are performed by the laser writing apparatus 40 as described above according to the third embodiment.

When the operation starts (step S301), the writing control unit 41 obtains ID data that specifies the contents written on the rewritable paper 20 attached to the container 10 conveyed by the conveyor 30 via the barcode reader 50 (step S302).

Then, the container 10 to be rewritten is conveyed by the conveyor 30 to the position where the laser marker apparatus 42 rewrites the rewritable paper 20.

When the container 10 is conveyed by the conveyor 30 to the position where the laser marker apparatus 42 rewrites the rewritable paper 20, a signal for rewriting is sent from the delivery management system 450 and the data receiving unit 410 of the writing control unit 41 receives data to be written on the rewritable paper 20 attached to the container 10 sent from the delivery management system 450 (step S303). Then, the drawing data generating unit 412 of the writing control unit 41 generates drawing data for the laser marker apparatus 42 to write new drawings on the rewritable paper 20 based on the received data to be written (step S304).

Thereafter, erasing operation are performed. In this embodiment, the written data receiving unit 416 of the writing control unit 41 sends the ID data of the rewritable paper 20 read by the barcode reader 50 to the delivery management system 450 (step S305). Then, the written data receiving unit 416 receives the written data corresponding to the written drawings written on the rewritable paper 20 attached to the container 10 from the delivery management system 450 (step S306).

The erasing data generating unit 414 of the writing control unit 41 analyzes the written data received by the written data receiving unit 416 and extracts written areas corresponding respectively to the object units where the drawing is currently written (step S307).

Figure 15:
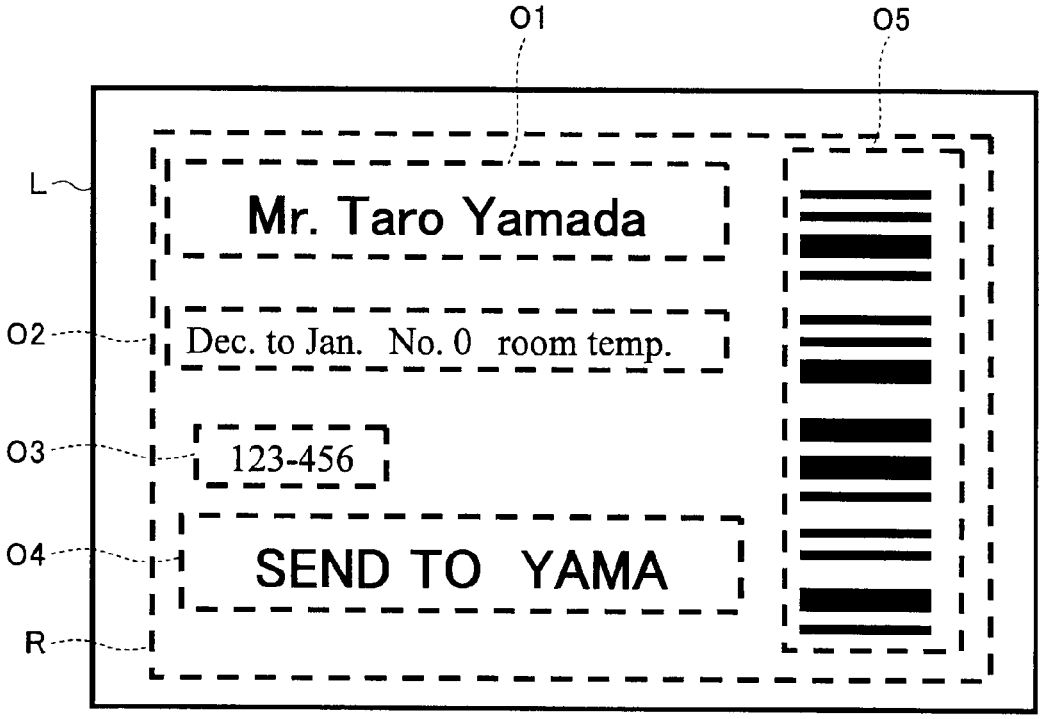
FIG. 15 is a drawing showing an example of the label.

FIG. 15 is a drawing showing an example of a label in which the areas surrounded by the dotted lines O1 to O5 express the corresponding object units. Concretely, the erasing data generating unit 414 analyzes the drawing data, obtains coordinate values of strokes where the laser condition is ON (Sp and Ep correspond with laser ON/OFF condition R of "1" as shown in FIG. 3) and determines drawing areas that surround the drawings based on the thus obtained coordinate values by extracting the minimum values and the maximum values of the strokes.

Then, the erasing data generating unit 414 sets appropriate erasing areas for the object units, by for example, expanding the written area as large as the width of the laser light or the like in a similar manner as determined in the first embodiment, and then generates erasing data for the laser marker apparatus 42 to erase the image written on the area of the rewritable paper 20 (step S308).

In this embodiment, the erasing areas of the erasing data are areas surrounded by dotted lines O1 to O5 corresponding to the object units, not an area surrounded by the dotted line R as shown in FIG. 15. It means that the erasing operation is performed for each of the object units and therefore the area necessary to erase can be reduced compared with the case when all the area of the label (L) or area surrounding all of the object units (R) is erased.

The laser marker apparatus 42 performs the erasing operation of erasing the drawings written on the rewritable paper 20 attached to the container 10 based on the thus generated erasing data (step S309), then performs writing operations on the rewritable paper 20 attached to the container 10 (step S310), and the process ends (step S311).

By performing those steps, the erasing area where the laser marker apparatus 42 is to erase the drawings becomes only the areas where some drawings are already written, for example, areas surrounded by the dotted lines O1 to O5 of FIG. 15 as explained above and therefore the time necessary for the erasing operation can be shortened.

Further, since the erasing areas can be determined simply by referring to the written data of the drawings currently written on the rewritable paper 20 without including comparisons, the erasing data can be generated with a shortened time.

Another Example

Figure 16:
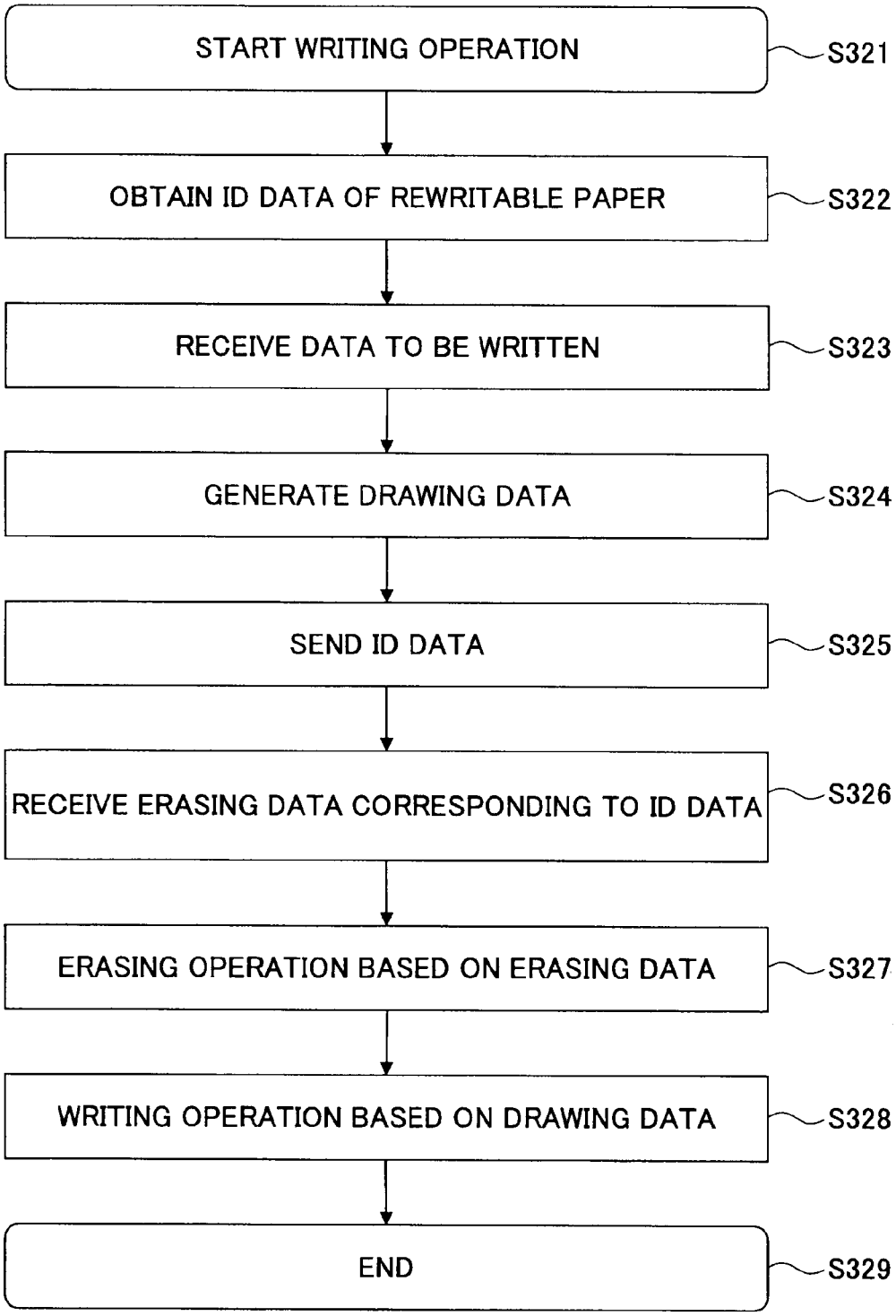
FIG. 16 is a flowchart showing another example of an operation in which laser erasing and laser writing processes are performed according to the third embodiment.

FIG. 16 is a flowchart showing another example of an operation in which laser erasing and laser writing processes are performed by the laser writing apparatus 40 as described above according to the third embodiment.

In this example, the delivery management system 450 may previously store one or more erasing data corresponding to a format of the drawings written on the rewritable paper 20.

The erasing data may be previously generated by the writing control unit 41 and then stored in the delivery management system 450, or alternatively, the delivery management system 450 may generate the erasing data and store it.

When the operation starts (step S321), the writing control unit 41 obtains ID data that specifies the contents written on the rewritable paper 20 attached to the container 10 conveyed by the conveyor 30 via the barcode reader 50 (step S322).

Then, the container 10 to be rewritten is conveyed by the conveyor 30 to the position where the laser marker apparatus 42 rewrites the rewritable paper 20.

When the container 10 is conveyed by the conveyor 30 to the position where the laser marker apparatus 42 rewrites the rewritable paper 20, a signal for rewriting is sent from the delivery management system 450 and the data receiving unit 410 of the writing control unit 41 receives data to be written on the rewritable paper 20 attached to the container 10 sent from the delivery management system 450 (step S323). Then, the drawing data generating unit 412 of the writing control unit 41 generates drawing data for the laser marker apparatus 42 to write new drawings on the rewritable paper 20 based on the received data to be written (step S324).

Thereafter, erasing operations will be performed. The written data receiving unit 416 of the writing control unit 41 sends the ID data of the rewritable paper 20 read by the barcode reader 50 to the delivery management system 450 (step S325).

Then, the delivery management system 450 detects the format of the drawings based on the ID data received in step S325, and sends erasing data corresponding to the format to the writing control unit 41. The written data receiving unit 416 of the writing control unit 41 receives the erasing data (step S326).

Alternatively, the barcode written on the rewritable paper 20 and read in step S322 may include ID data that specifies erasing data to be used for erasing the drawings itself instead of or in addition to the ID data specifying the content of the drawings. In such a case, the delivery management system 450 may store the erasing data with the respective ID data corresponding to the barcode written on the rewritable paper 20 as the part of the drawings. With such a structure, the delivery management system 450 can simply select the respective erasing data without detecting the format of the drawings.

The laser marker apparatus 42 performs an erasing operation to the rewritable paper 20 attached to the container 10 based on the thus obtained erasing data (step S327), then performs a writing operation on the rewritable paper 20 attached to the container 10 (step S328), and the process ends (step S329).

By performing those steps, the erasing area where the laser marker apparatus 42 is to erase the drawings becomes only the areas where some drawings are already written and therefore the time necessary for the erasing operation can be shortened. Further, by storing previously generated erasing data and obtaining the respective erasing data in accordance with the format of the written drawings, there is no need to generate the erasing data every time the erasing operation is performed. Therefore, the time necessary for rewriting operations can be further shortened.

The previously generated erasing data may be stored in the storing unit (not shown in the drawings) of the writing control unit 41. In such a case, the writing control unit 41 may not include the written data receiving unit 416. The erasing data generating unit 414 may obtain the respective erasing data from the storing unit based on the format or the ID data of the drawings without referring to the delivery management system 450.

Another Example

Figure 17:
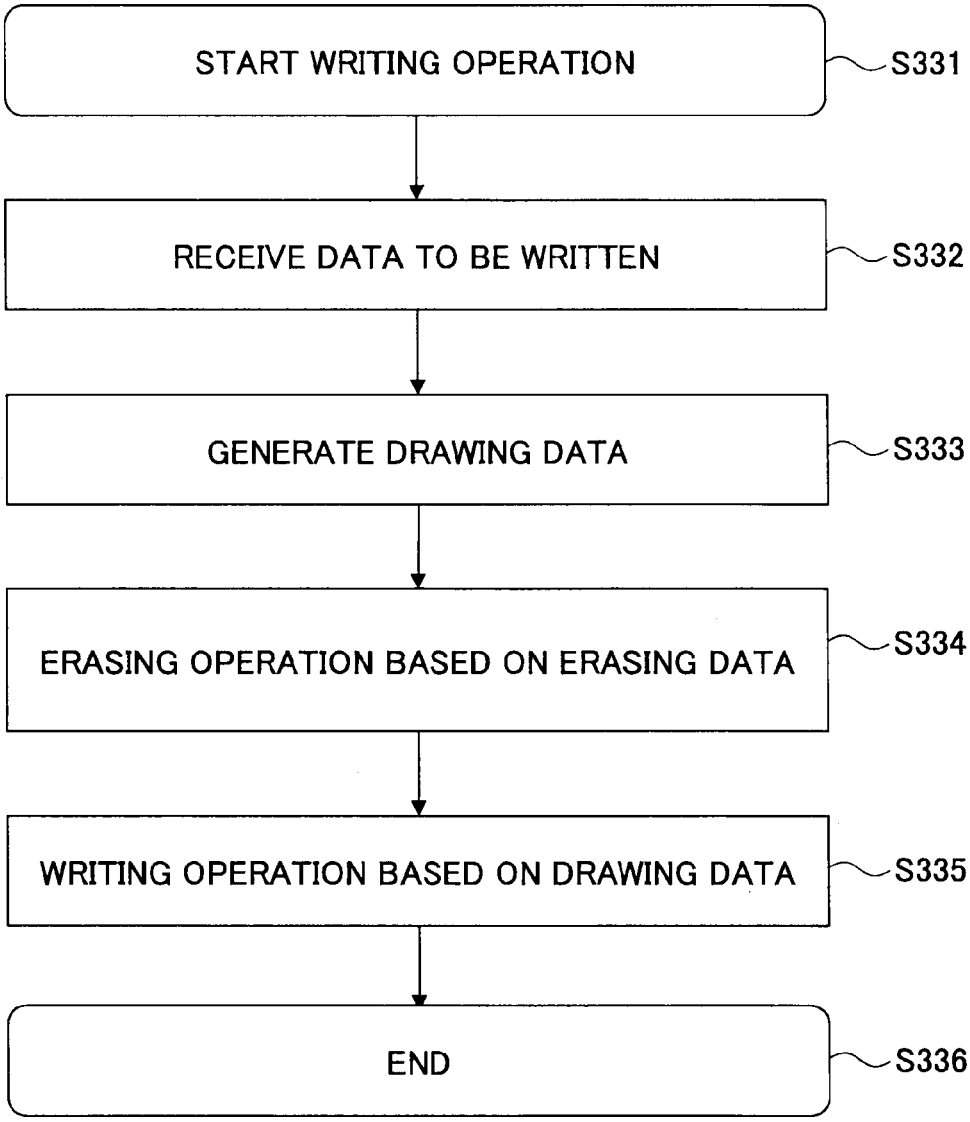
FIG. 17 is a flowchart showing another example of an operation in which laser erasing and laser writing processes are performed according to the third embodiment.

FIG. 17 is a flowchart showing another example of an operation in which laser erasing and laser writing processes are performed by the laser writing apparatus 40 as described above according to the third embodiment.

The previously generated erasing data may be stored in the storing unit (not shown in the drawings) of the writing control unit 41 when the format of the drawings used and written in the delivery center is set as a single format, for example.

In such a case, the barcode reader 50 is not necessary. Further, the writing control unit 41 may not include the written data receiving unit 416. The erasing data generating unit 414 can obtain the erasing data from the storing unit without referring to the delivery management system 450.

When the operation starts (step S331), the data receiving unit 410 of the writing control unit 41 receives data to be written on the rewritable paper (step S332), and the drawing data generating unit 412 of the writing control unit 41 generates drawing data (step S333).

Next, the erasing operation is performed (step S334), the writing operation in accordance with the drawing data is performed (step S335), and the process ends (step S336).

In this case, the cost can be reduced as the barcode reader 50 is not necessary. Further, the rapid operation can be performed as the communication with the delivery management system 450 is not necessary.

According to the above embodiments, when rewriting a drawing written on a rewritable paper attached to a container by a laser light, a rewriting operation can be performed efficiently and rapidly according as an environment of such as a delivery center or factory.

For example, when formats of drawings to be written on labels, rewritable papers, are not uniform and many kinds of formats exist where size of drawings or a number of object units vary for cases, the case as explained in the first embodiment may be appropriate so that a time necessary for a rewriting operation can be reduced. At this time, the erasing area may be set as one region that includes all of the object units when the drawings to be written exist in the whole area of the label, the erasing area may be set for each of the object units when the drawings to be written partially exist on the label, and the erasing area may be obtained from a host apparatus as the delivery management system 450 when the drawings to be written exist on a small area of the label.

Further for example, when the difference between the drawings to be written on each label is small, the case as explained in the second embodiment where only the different part between the written drawings and the drawings to be written is rewritten may be appropriate so that a time necessary for a rewriting operation can be reduced to minimum.

Further for example, when formats of drawings to be written on labels, rewritable papers, are not uniform and many kinds of formats exist but a number of object units to be written is small, the case as explained in the third embodiment where erasing data that includes only erasing areas corresponding to the object units is generated may be appropriate.

Further, for example, when there exists only a single or a few formats for drawings, erasing data may be previously generated and stored so that at the time of rewriting, the appropriate erasing data corresponding to the format of the drawings written on the label can be used without generating erasing data as explained in another example of the third embodiment.

The writing control unit 41 may be structured to provide any combination of the embodiments as described above and to receive selection by a user of which embodiment is to be used to provide the selected embodiment.

In the above embodiments, the writing control unit 41 includes the data receiving unit 410 and the drawing data generating unit 412 and the drawing data generating unit 412 generates drawing data based on the data to be written on the rewritable paper 20. However, alternatively, the writing control unit 41 may not include the drawing data generating unit 412.

In such a case, the data receiving unit 410 of the writing control unit 41 may receive the drawing data from an external device such as the delivery management system 450.

Alternatively, the writing control unit 41 may include a storing unit that stores drawing data to be written. In such a case, the drawing data may be previously generated in an external device or the like and the writing control unit 41 may previously receive such a drawing data and store it in the storing unit.

Further, when the erasing data generating unit 414 identifies a position of an erasing area based on written data corresponding to a drawing currently written on the rewritable paper 20 and a drawing data to be written on the rewritable paper 20, the erasing data generating unit 414 may set the erasing area to be a bit larger than a new drawing area where the new drawing is to be written when a current drawing area for the currently written drawing is larger than the new drawing area in order to differentiate the drawing written by rewriting operations and the remaining drawing of the currently written drawing.

According to the image forming apparatus of the embodiments, erasing areas for erasing drawings written on a part of a thermal rewritable recording medium such as a rewritable paper or the like can be efficiently set, when an erasing operation is performed without using an additional device for erasing the drawings.

Further, according to the techniques disclosed in Japanese Laid-open Patent Publication Nos. 2007-216422, 2004-322493 and 2008-194905, a device for erasing the drawings already written on the thermal paper is necessary in addition to an apparatus for writing a new content and therefore raising costs. In the image forming apparatus of the present embodiment, erasing operations and writing operations can be performed by the laser marker apparatus 42 and therefore, there is no need to provide an additional device for erasing the drawings.

The present invention is not limited to the specifically disclosed embodiments, and variations and modifications may be made without departing from the scope of the present invention.

The present application is based on Japanese Priority Application No. 2010-288221 filed on Dec. 24, 2010, the entire contents of which are hereby incorporated herein by reference.

What is claimed is:

1. An image forming apparatus comprising:

a laser unit that has a function to emit a laser light to heat a thermal rewritable recording medium to write drawings on to the thermal rewritable recording medium and to erase drawings written on the thermal rewritable recording medium by heating the thermal rewritable recording medium;

an erasing data generating unit that generates erasing data indicative of a position of an erasing area corresponding to a part of the thermal rewritable recording medium;

a barcode reader; and a written data receiving unit, wherein the laser unit erases a drawing written on the erasing area of the thermal rewritable recording medium based on the erasing data generated by the erasing data generating unit, wherein the erasing data generating unit identifies the position of the erasing area based on written data corresponding to a drawing currently written on the thermal rewritable recording medium and drawing data to be written on the thermal rewritable recording medium and generates the erasing data based on the erasing area and the position identified, wherein the drawing currently written on the thermal rewritable recording medium includes a barcode indicating an ID data for specifying the written data, and wherein the barcode reader reads the barcode to obtain the ID data and the written data receiving unit receives the written data based on the ID data.

2. The image forming apparatus according to claim 1, wherein the erasing data generating unit sets the erasing area to surround a drawing area on the thermal rewritable recording medium.

3. The image forming apparatus according to claim 1, wherein a drawing that the laser unit is to write includes plural object units and the erasing data generating unit identifies the position of the erasing area to correspond to the plural object units.

4. The image forming apparatus according to claim 1, wherein the erasing data generating unit obtains information including the erasing area from an external apparatus.

5. The image forming apparatus according to claim 1, wherein the erasing data generating unit compares the written data and the drawing data and identifies the position of the erasing area as a different part between the written data and the drawing data to generate the erasing data, and the laser unit is controlled not to write a portion of a drawing to be written corresponding to an area where a same drawing exists.

6. The image forming apparatus according to claim 1, wherein the erasing data generating unit compares the written data and the drawing data and identifies the position of the erasing area not to include an area where a same drawing exists to generate the erasing data, and the laser unit is controlled not to write a portion of a drawing to be written corresponding to the area where the same drawing exists.

7. An image forming apparatus comprising:

a laser unit that has a function to emit a laser light to heat a thermal rewritable recording medium to write drawings on the thermal rewritable recording medium and to erase drawings written on the thermal rewritable recording medium by heating the thermal rewritable recording medium;

an erasing data generating unit that generates erasing data indicative of a position of an erasing area corresponding to a part of the thermal rewritable recording medium;

a barcode reader; and a written data receiving unit, wherein the laser unit erases a drawing written on the erasing area of the thermal rewritable recording medium based on the erasing data generated by the erasing data generating unit, wherein the erasing data generating unit identifies the position of the erasing area based on written data corresponding to a drawing currently written on the thermal rewritable recording medium and generates the erasing data based on the erasing area and the position identified, and wherein the drawing currently written on the thermal rewritable recording medium includes a barcode indicating an ID data for specifying the written data, and wherein the barcode reader reads the barcode to obtain the ID data and the written data receiving unit receives the written data based on the ID data.

8. The image forming apparatus according to claim 7, wherein the erasing data generating unit identifies the position of the erasing area by analyzing a content of the written data.

9. The image forming apparatus according to claim 7, wherein the erasing data generating unit obtains erasing data corresponding to the drawing currently written on the thermal rewritable recording medium and previously stored in a storing unit with respect to a data format of the drawings written on the thermal rewritable recording medium.

10. The image forming apparatus according to claim 7, further comprising a storing unit that stores erasing data corresponding to the drawing currently written on the thermal rewritable recording medium.

11. The image forming apparatus according to claim 7, wherein the erasing data generating unit sets the erasing area to surround a drawing area on the thermal rewritable recording medium.

12. The image forming apparatus according to claim 7, wherein the drawing currently written on the thermal rewritable recording medium includes plural object units and the erasing data generating unit identifies the position of the erasing area to correspond to the plural object units.

13. The image forming apparatus according to claim 7, wherein the erasing data generating unit obtains information including the erasing area from an external apparatus.

14. A method of image forming comprising:

emitting a laser light to heat a thermal rewritable recording medium to write a drawing on the thermal rewritable recording medium and to erase a drawing written on an erasing area corresponding to a part on the thermal rewritable recording medium by heating the thermal rewritable recording medium, a drawing currently written on the thermal rewritable recording medium including a barcode indicating an ID data for specifying written data;

generating erasing data indicative of a position of the erasing area, wherein generating erasing data includes reading the barcode by a barcode reader to obtain the ID data, and receiving the written data based on the ID data, identifying the position of the erasing area based on the written data, and generating the erasing data based on the erasing area and the position identified, and wherein emitting the laser light includes erasing the drawing written on the erasing area of the thermal rewritable recording medium based on the erasing data that is generated.

15. The method of image forming according to claim 14, wherein identifying the position of the erasing data includes analyzing a content of the written data.

16. The method of image forming according to claim 14, wherein generating the erasing data includes obtaining erasing data corresponding to the drawing currently written on the thermal rewritable recording medium previously stored in a storing unit with respect to a data format of drawings written on the thermal rewritable recording medium.

17. The method of image forming according to claim 14, further comprising storing erasing data corresponding to the drawing currently written on the thermal rewritable recording medium in a storing unit.

18. The method of image forming according to claim 14, wherein generating erasing data includes setting the erasing area to surround a drawing area on the thermal rewritable recording medium.

19. The method of image forming according to claim 14, wherein the drawing currently written on the thermal rewritable recording medium includes plural object units, and wherein identifying the position of the erasing area includes identifying the position to correspond to the plural object units.

20. The method of image forming according to claim 14, wherein the generating the erasing data includes obtaining information including the erasing area from an external apparatus.

* * * * *